US005303844A

United States Patent [19]

Muehlberger

[11] Patent Number: 5,303,844

[45] Date of Patent: Apr. 19, 1994

[54] AUTOMATED APPARATUS, SYSTEM AND METHOD FOR RELIABLY VENDING ARTICLES OF INCREASED VALUE

[75] Inventor: Karl H. Muehlberger, Lakeland, Fla.

[73] Assignee: Keyosk Corporation, Lakeland, Fla.

[21] Appl. No.: 876,075

[22] Filed: Apr. 28, 1992

[51] Int. Cl.[5] ..... G07F 11/36

[52] U.S. Cl. ..... 221/1; 221/13; 221/75; 235/381

[58] Field of Search ..... 194/205, 212; 221/13, 221/14, 75, 195, 196, 281, 312 R, 312 B, 1; 235/381; 364/479

[56] References Cited

U.S. PATENT DOCUMENTS

| | | | |
|---|---|---|---|
| 2,500,437 | 3/1950 | Tandler et al. | 221/13 |
| 2,799,430 | 7/1957 | Kintzel | 194/255 X |
| 4,414,467 | 11/1983 | Gould et al. | 194/906 |
| 4,494,675 | 1/1985 | Stutsman | 221/13 |
| 4,639,875 | 1/1987 | Abraham et al. | 235/381 X |
| 4,706,794 | 11/1987 | Awane et al. | 364/479 X |
| 4,757,915 | 7/1988 | Albright et al. | 221/75 |
| 4,839,505 | 6/1989 | Bradt et al. | 221/88 X |
| 4,893,705 | 1/1990 | Brown | 194/211 |

*Primary Examiner*—F. J. Bartuska

*Attorney, Agent, or Firm*—Allen, Dyer, Doppelt, Franjola & Milbrath

[57] ABSTRACT

A vending machine has a front panel with plural removable storage and dispensing trays extending through the enclosure, and defining a rear vertical chute curving gradually in a horizontal direction under the trays and communicating with a vend opening. The machine includes a bar code reader or similar input apparatus for receiving plural control and inventory inputs representative of a UPC code for articles to be inserted in each tray position, the quantity of articles inserted in each tray position, the identity of the tray position and the selection button corresponding to each tray position. A sensor is located at the back of each tray position at the exit into the chute, for detecting when an individual article passes into the chute to provide a sensing output, the operation of the tray position being continued until an article is dispensed into the chute.

14 Claims, 6 Drawing Sheets

AUTOMATED APPARATUS, SYSTEM AND METHOD FOR RELIABLY VENDING ARTICLES OF INCREASED VALUE

BACKGROUND OF THE INVENTION

The present invention relates to apparatus, systems and methods for vending articles, and in particular to automated techniques for reliably vending articles of increased value.

There have been a number of systems and methods developed for vending articles of relatively modest cost, such as candy bars, soft drinks, cigarettes and the like. Some prior art systems suffer from reliability, when a machine jam occurs, and are also susceptible to theft losses.

There has been developed in the prior art automated vending and retrieval machines for certain articles of increased value, such as video tapes. See for example, U.S. Pat. No. 4,893,705 to Brown.

SUMMARY OF THE INVENTION

Among the objectives of the present invention is the provision for an automated system and method for reliably vending articles of increased value, the acceptance of credit/debit cards, on-line automated inventory analysis, and the capability for displaying a portion of the article of possible interest to a consumer, such as a portion of the audio of a compact disk, or a portion of a video tape. To obtain these objectives, the system of the present invention comprises an enclosure having an opening through which selected articles are vended, and plural article selection means along a front panel of the enclosure for permitting a customer to select one of a plurality of articles through initiation of a vend selection sequence. Multiple independent article storing and dispensing means are removably fitted within the enclosure, each capable of storing a plurality of articles and then dispensing an individual article along a secured path within the enclosure toward the vend opening, responsive to the customer selection and after the customer has made an appropriate payment either with cash or use of a credit or debit card. A sensor is positioned at each storage and dispensing means and along the path for detecting when an individual article is moving along the path toward the vend opening, and providing a sensing output responsive to that movement. Means are also provided for controlling the operation of the selected storage and dispensing means responsive to the sensor output, to continue operation of the storage and dispensing means until such time as a selected article is in fact dispensed into the vend opening, to thereby reliably insure that the customer receives the selected article.

In a preferred embodiment, the system is provided with a plurality of horizontal trays removably fitted with the enclosure, each tray fitted with a plurality of the storage and dispensing means, each of which may, for example, comprise a motor-driven helix extending from a front side to a discharge end along the back side of the corresponding tray. In this form, the back side is bevelled downwardly and outwardly toward a vertically-extending chute forming the path, with each corresponding sensor mounted along the bevelled back side. The vertical chute extends along the back of the enclosure, and downwardly to a gradual horizontal curvature terminating just below the vend opening.

To further enhance reliability, the system is provided with a second sensor located at the discharge end of each helical storage rack, for providing a second output as the vended article passes through the discharge end. Thus, in operation, the system relies upon both inputs to insure that the customer receives the selected article.

The removable trays are interchangeable, so that articles of different widths may be vended in the same machine.

In order to impart the desired inventory control features, the system is provided with means, such as a bar code reader, for detecting the UPC code for the articles to be inserted into a specific tray position, and to also independently detect indicia representing the tray position, the quantity of articles inserted in that tray position, the specific article selection button on the front of the machine, and any audio or video track to be specifically available for customer review for that particular article. All of this inventory information is provided as an input to a central processing unit, which is electronically coupled with each article selection button, each tray position and/or video and audio storage facilities. The central processing unit also receives or provides inputs from a customer-operated key pad, card reader and cash receiver, and provides inputs to a customer-viewable monitor and a receipt printer. The use of independent coding features for each tray position, the article quantity and article selection buttons permits a high degree of flexibility in terms of monitoring inventory, as well as maintaining a current and accurate status as to the interrelationship between each article selection button and the corresponding tray dispenser where the articles associated with a particular article selection button are in fact located for vending.

The system, including the central processing unit, has the capability of either real time or off-line credit or debit card verification through an appropriate modem, the modem also being available to provide remote inventory information, for example, to a central office located remotely from the vending system.

THE DRAWING

DETAILED DESCRIPTION

The construction details of a machine incorporating the vending system of the present invention will be described in detail with reference to FIGS. 1–6, followed by a description of the electronic circuit functions of the system with reference to FIG. 7.

Figure 1:
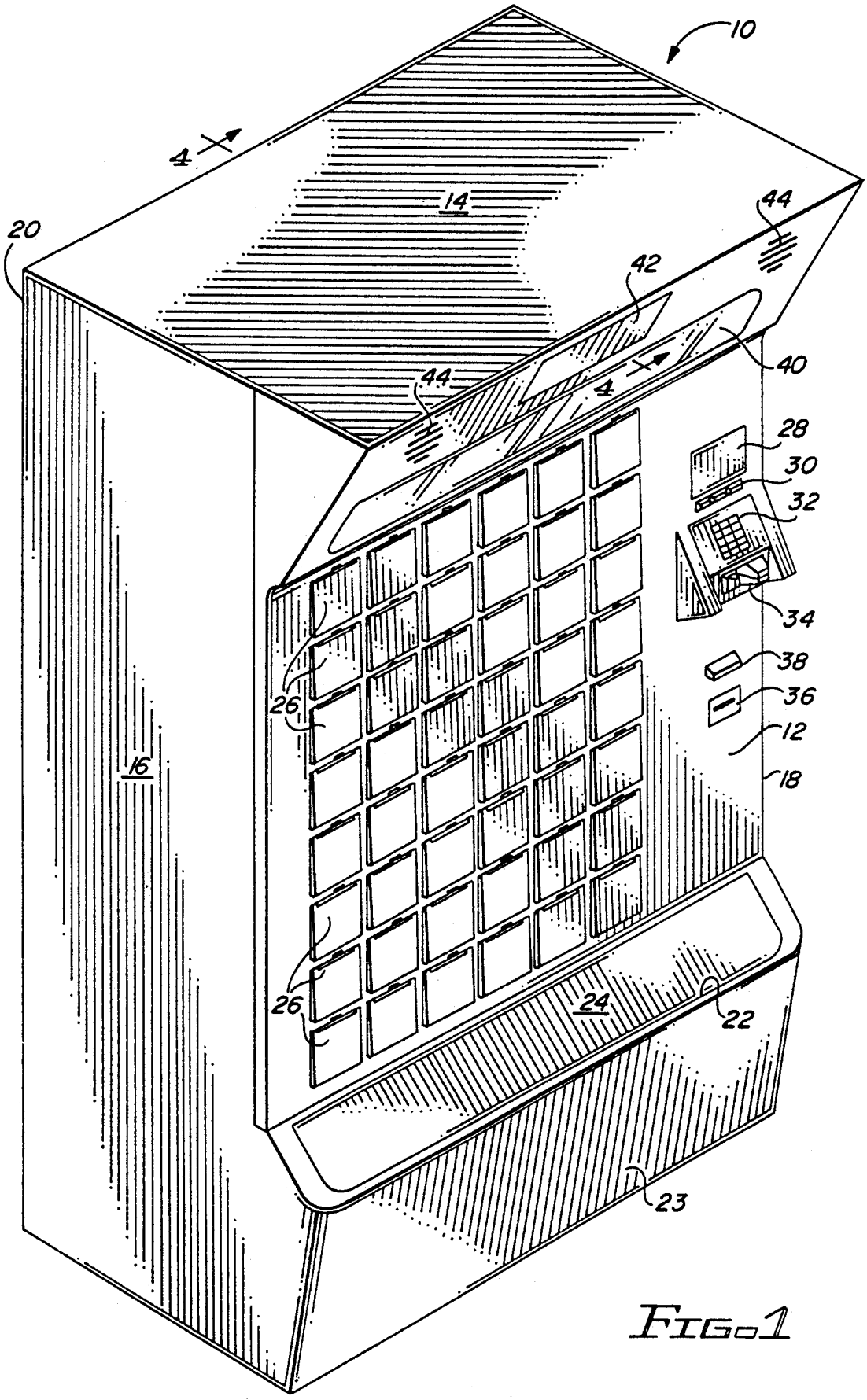
FIG. 1 is a perspective view of a machine incorporating the vending system of the present invention.

First noting FIG. 1, the vending machine 10 is defined by an enclosure having a front panel 12, a top 14, rear 20 and opposing left and right sides 16–18 respectively. The bottom of the machine 10 includes a chute housing 23, through the upper portion of which extends a horizontal chute delivery panel 70, described in greater below with reference to FIG. 4. The chute housing 23 includes a vend opening 22 at the upper surface thereof, with an access door 24 hinged across the vend opening.

The machine 10 includes plural article selection buttons 26 mounted in the front panel 12, and extending slightly rearwardly through corresponding openings. Also accessible from the front panel 12 is a CRT monitor 28, key pad 32, credit/debit card reader 34, receipt printer 36 and cash acceptor opening 38. All of these features are electronically coupled with a central processing unit for automated operation of the vending machine 10, as is described in greater detail below with reference to FIG. 7.

As is also depicted in FIG. 1, the vending machine 10 includes a back-lighted name plate 40, a video monitor 42 and audio speakers 44.

Figure 2:
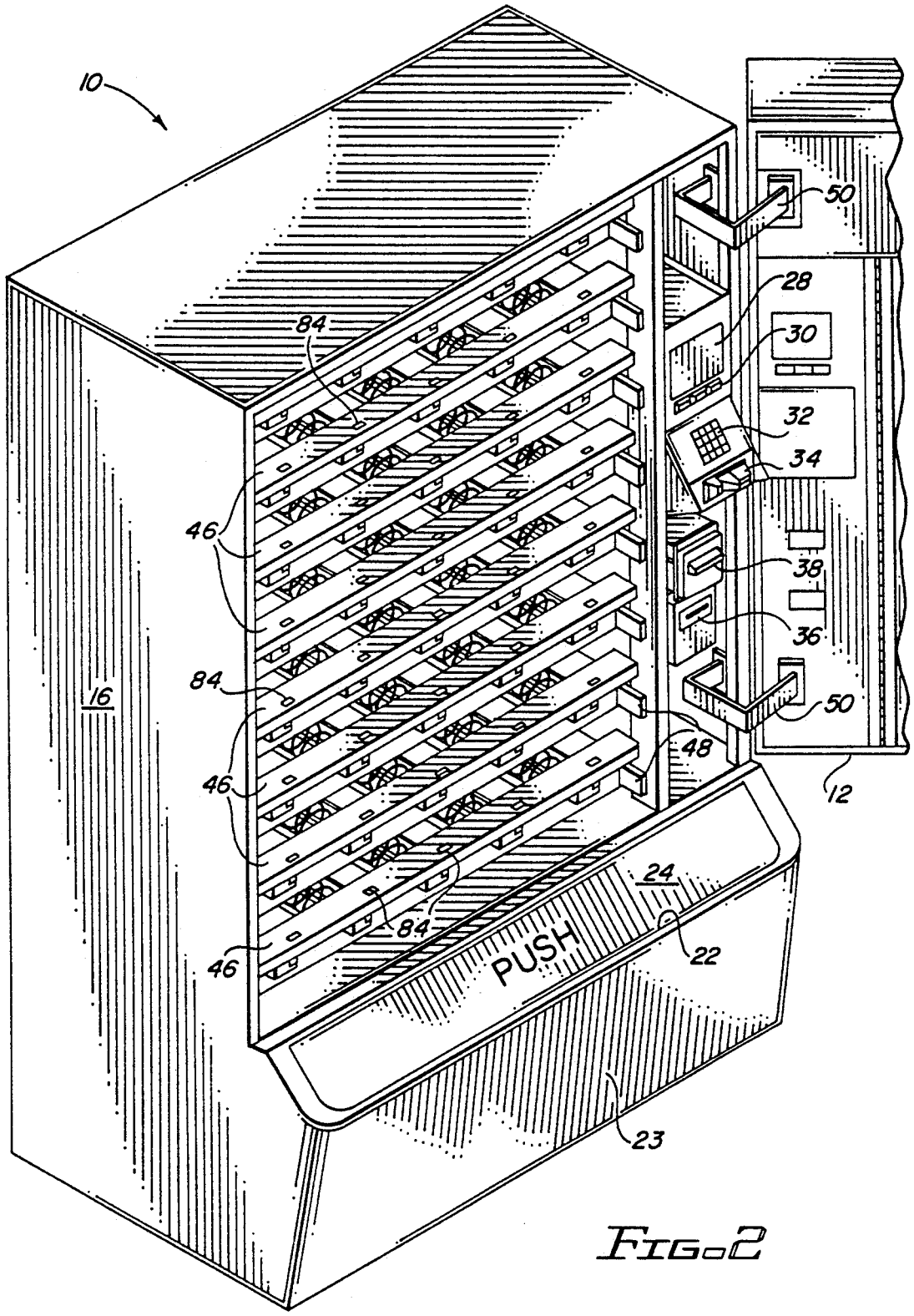
FIG. 2 is a perspective view like FIG. 1, with the front panel of the system opened, and with the panel partially cut away.

FIG. 2 illustrates the vending machine 10 with the front panel 12 opened to illustrate plural, removable storage and dispensing trays 46 mounted on horizontal rails 48 extending from front to rear within the enclosure of the vending machine 10. The construction details of the storage and dispensing trays 46 is described in detail below with reference to FIGS. 5 and 6.

Figure 3:
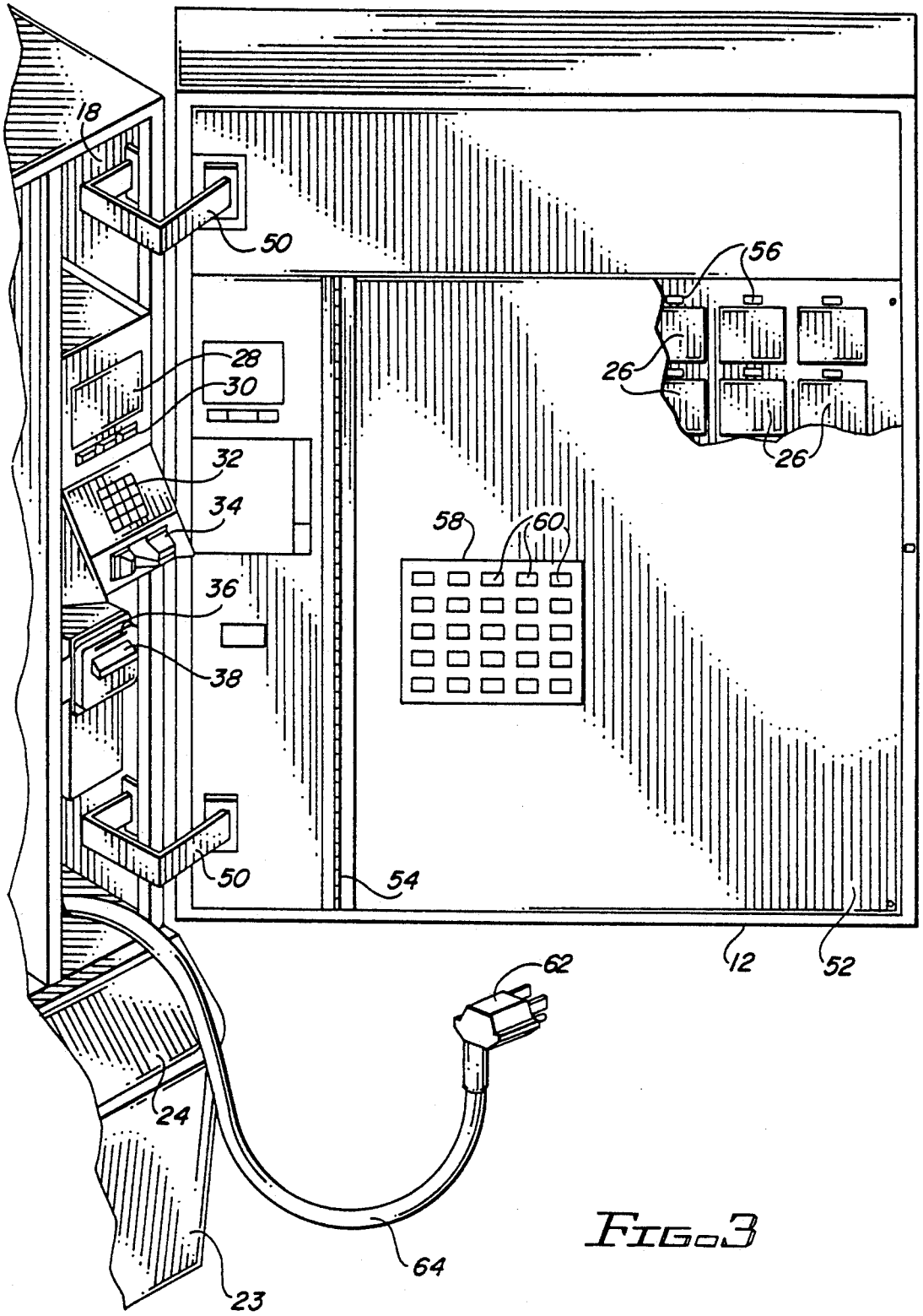
FIG. 3 is a view like FIG. 2, with a portion of the vending system cut away, and illustrating the front panel in elevation.

As with FIG. 2, FIG. 3 depicts the vending machine with the front panel 12 open. As there shown, the front panel 12 is mounted by hinges 50 to the right side 18. The front panel 12 includes a security panel 52 spaced from that portion of the panel containing the selection buttons 26 to restrict access only to authorized persons. As shown by the cut away portion in FIG. 3, each selection button 26 has an associated bar code stripe 56, with each stripe containing a unique bar code to identify the corresponding selection button 26. Likewise, the vending machine 10 is provided with a "quantity" bar code striped panel 58 which, for example, may be mounted along the security panel 52, the panel 58 including plural bar code stripes 60, each of which identifies a separate numeral, and has utility by an authorized person to identify the quantity of articles loaded in an individual vending position for each storage and dispensing tray 46, as described below with reference to FIG. 7. As is also shown in FIG. 3, the vending machine 10 is provided with a bar code reader 62, coupled by a cable 64 to the electronics within the vending machine 10, the cable 64 having a sufficient length to permit the reader 62 to be used to read the bar code stripes 56 and 60, as well as each tray position bar code stripe 84 (FIGS. 2 and 5).

Figure 4:
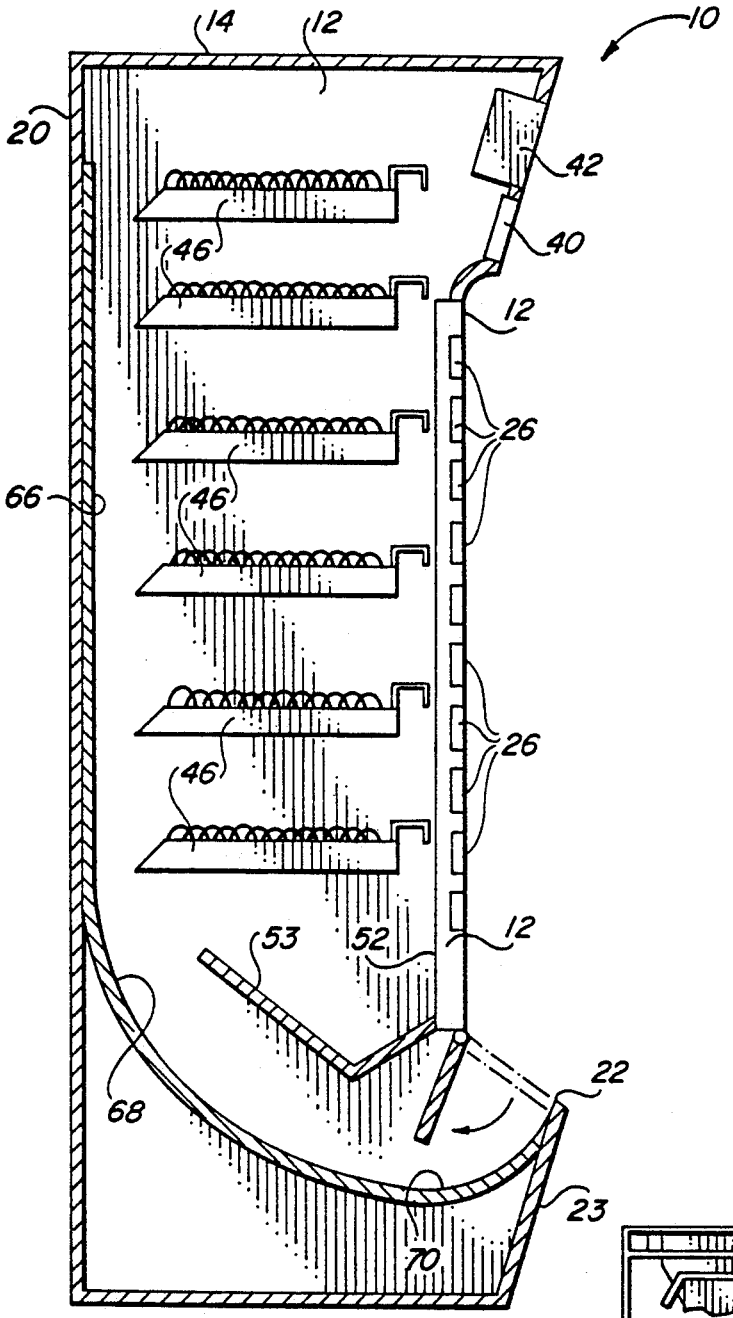
FIG. 4 is a cross sectional side view of the vending system of FIG. 1, taken along the lines 4—4 in FIG. 1.

Turning now to FIG. 4, the vending machine 10 is shown in cross section, and depicts a vertical, low-friction chute panel 66 extending along the rear of the vending machine 10, and facing the discharge end of each storage and dispensing tray 46. The chute includes a gradual curvature, including portions 68, 70, so as to feed articles dropped from the discharge end of each storage and dispensing tray 46 downwardly along the low friction surface 66, and then along the gradual curvatures for access through the vend opening 22. Shield member 53 protects the machine 10 from being defrauded through the opening 22.

Figure 6:
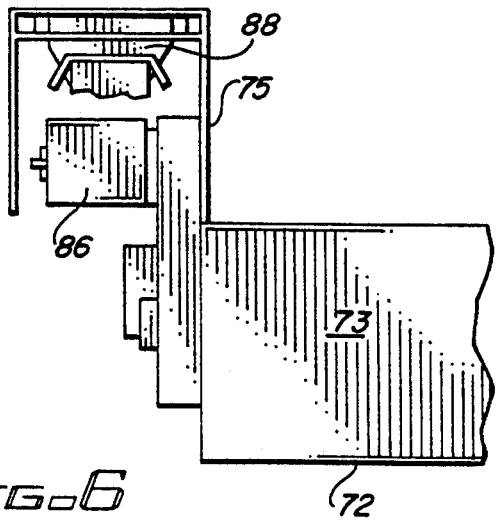
FIG. 6 is a partial end view of the tray of FIG. 5, taken along the line 6—6 in FIG. 5.
Figure 5:
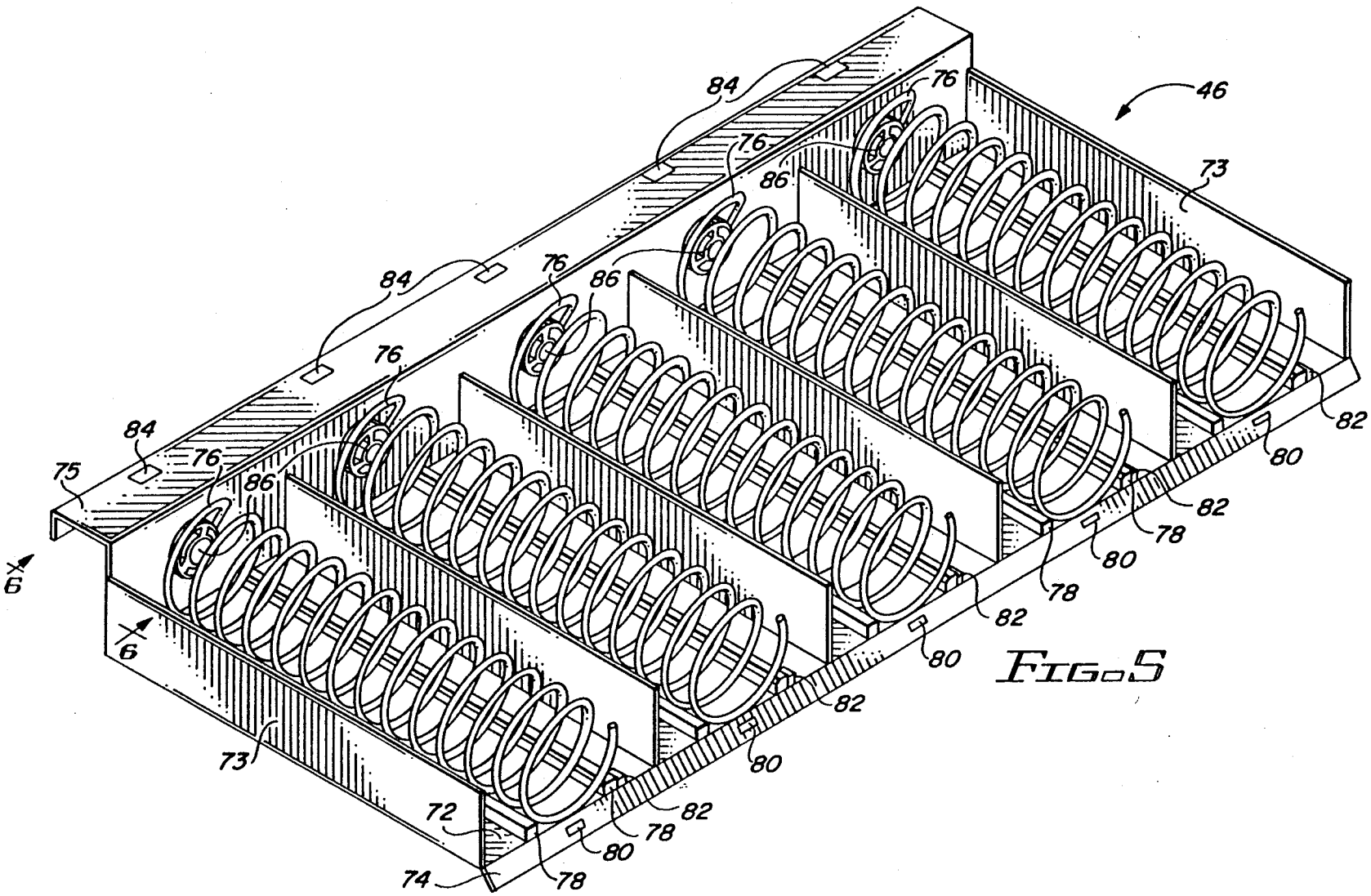
FIG. 5 is a perspective illustration of a multiple-position storage and dispensing tray useful with the vending system of FIGS. 1–4.

Construction details of each storage and dispensing tray 46 is shown in FIGS. 5 and 6. Each tray 46 includes a horizontally disposed tray plate 72, a bevelled back side 74 which, as shown in FIG. 4, is bevelled downwardly and outwardly toward the chute upper portion 66. Each tray includes a generally U-shaped forward bracket 75, in which are mounted plural motors 86 which are controlled by an input output circuit board 88. Each tray 46 includes plural helical storage racks 76, each of which is coupled to an individual drive motor 86, and which are mounted between parallel support rails 78 extending front to rear along the tray plate 72. It will of course be understood that, while the tray 46 shown in FIG. 5 contains five helical storage racks 76, that removable trays may be provided with a greater or lesser number of storage racks, depending upon the width of the articles to be vended from a particular tray 46 or from a specific storage location.

Each storage and dispensing rack 76 on each tray 46 is provided with two sensors, including a first sensor 80 positioned along the bevelled back side 74, and in line with the rear, discharge end of an associated storage rack 76. Additionally, a second sensor 82 is mounted at the discharge end of each helical storage rack 76. In operation, the first sensor so is adapted to detect and provide an output when an article actually slides across the bevelled surface 74 and into the chute 66, and the second sensor 82 is designed to detect the presence or absence of an article in the storage helix 76 at its discharge end. The outputs of these two sensors are used to insure that an article selected by the customer is actually vended from the discharge end and down the chute.

Figure 7:
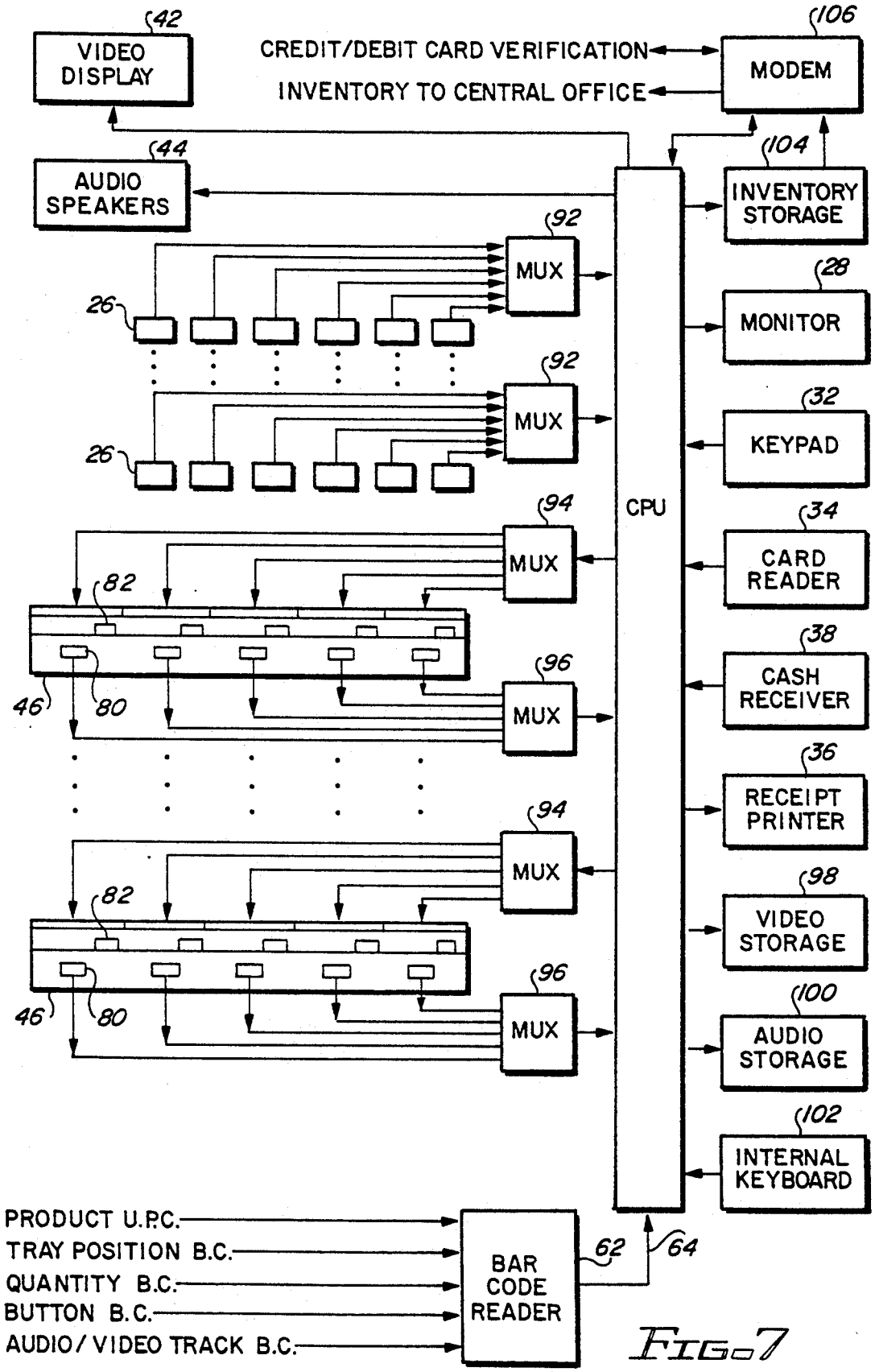
FIG. 7 is a block diagram illustrating the electronic operation of the vending system of FIGS. 1–6.

Referring now to FIG. 7, the bank of article selection buttons 26 are depicted schematically, with each row of buttons being multiplexed together in a multiplex unit 92, the output of which is provided as an input to a central processing unit 90 in accordance with conventional micro processor technology. Similarly, each storage and dispensing tray 46 is shown somewhat schematically, with outputs from the central processing unit 90 being provided through a multiplexor 94 to the motors 86 of each storage and dispensing position of each tray 46, and with the corresponding outputs of the sensors so being provided as an output through a multiplexor 96 to the central processing unit 90. As also depicted schematically at the bottom of FIG. 7, the bar code reader 62 provides electronic inputs representative of a plurality of independent inventory information, which may include the following: (a) the product universal price code (UPC) information; (b) an input representative of a specific tray position bar code stripe, representing the location where a particular quantity of articles are being installed for vending, and read from the stripes 84 (FIG. 5); (c) an electronic input representative of the quantity of a particular article being installed into a specific vending tray position, as determined by the bar code stripes 60 from the panel 58 (FIG. 3); (d) an electronic representation of the specific article selection button 26 selected for use for a particular article to be vended from a particular tray position, as determined from the bar code stripe 56 for the selected article selection button (FIG. 3); and any other information specifically associated with a particular article to be vended, such as the audio or visual track in an internal video or audio storage facility 98, 100, respectively, which are interactive with the central processing unit 90, and provide some article specific information for a particular article available for vending. These inputs to the central processing unit 90 are then used to maintain the relationship between a particular article selection button 26, for purposes of identifying a specific storage and dispensing rack 76 from which the selective article is to be vended; and to determine the quantity of units available for vending, as each unit is sold. This information may be provided to an inventory storage 104, which then may be passed through a modem 106 to a remote inventory control center or central office.

Further in accordance with the present invention, the central processing unit 90 also has the capability of conducting a real time or off-line credit/debit card verification, by using the information received from the card reader 34 and providing an output through the modem 106 to a credit/debit card verification facility. When done real time, conventional verification techniques are used.

The sequence of operation will now be described with reference to FIGS. 1–7, inclusive.

Initially, a customer approaches the vending machine 10, and is greeted by a recorded message displayed on the CRT monitor 28, and invited to initiate either a purchase sequence or a display sequence by operation of an appropriate button 30 or key on key pad 32. By way of example, if the vending machine 10 is dedicated to the distribution of audio compact disk tapes, the customer may wish to listen to a portion of a specific tape of interest, before initiating the purchase sequence. To that end, the operation of a particular selection button 26 together with a designated button 30 will initiate playing of a short portion of the selected audio for the compact disk out of the audio storage facility 100, to the audio speakers 44, as controlled by the central processing unit 90. Assuming the customer wishes to purchase the designated compact disk as represented by the specific button 26, the CRT monitor 28 then invites the customer to operate a particular button 30 or key on key pad 32, together with the article selection button 26. The customer is then instructed to insert a credit or debit card into reader 34, the output of which is processed through modem 106 to a Credit/debit card verification facility, in accordance with a protocol established in the modem 106. If the results of the credit or debit card verification shows that there is sufficient funds available to pay for the particular article selected by the customer, then the vend sequence is continued by providing an output from central processing unit 90 to the input/output circuit controller 88 associated with a specific tray 46 (FIGS. 5, 6) and in turn initiates operation of an individual motor 86, to rotate the corresponding helix 76 to permit an article to be dispensed out of the discharge end of the selected storage helix 76 across the bevelled back side 74, which is sensed both by the first and second sensors so, 82. If an article is sensed at the discharge end by second sensor 82, but no passage of the article across the bevelled backside 74 is noted by first sensor so, then the central processing unit 90 detects that the articles are jammed in the discharge end, and alerts the customer to that fact and that no charge will be made to the customer for the selected article. However, if a sensed output is provided from both the first and second sensors 80, 82, then the Central processing unit recognizes that an article has been dispensed from the discharge end of the corresponding storage and dispensing helix 76 and the operation of the corresponding drive motor 86 may be then discontinued.

It will be understood by those familiar with the vending art that the system, apparatus and method of the present invention provides reliable techniques for vending articles of increased value, such as compact disks, video tapes, video games and the similar articles for which a person may purchase the articles utilizing conventional credit or debit cards.

This concludes the description of the preferred embodiments. A reading by those skilled in the art will bring to mind various changes without departing from the spirit and scope of the invention. It is intended, however, that the invention only be limited by the following appended claims.

What is claimed is:

1. Apparatus for vending articles, comprising:

an enclosure having an opening through which selected articles are vended;

plural article selection means along a front panel of the enclosure for permitting a customer to select one of a plurality of articles through initiation of a vend selection sequence;

multiple independent article storing and dispensing means within the enclosure, each storage and dispensing means capable of storing a plurality of articles and then dispensing an individual article across a corresponding discharge end and along a path within the enclosure toward the vend opening;

a first sensor at each storage and dispensing means and along the path for detecting when an individual article for the corresponding storage and dispensing means is moving along the path toward the vend opening, and providing a first sensing output responsive thereto;

means for controlling the operation of the selected storage and dispensing means responsive to the first sensor output to insure that a selected article is dispensed into the vend opening; and a second sensor at the discharge end for detecting and providing a second sensing output when an individual article passes through the discharge end, the controlling means receiving the second output and continuing operation of the selected storage and dispensing means until both the first and second sensing outputs are received from both the first and second sensors, to insure that the selected article is vended into the opening.

2. The apparatus recited in claim 1 wherein the opening is positioned below all of the storage and dispensing means, the path being defined by a gravity feed chute through the enclosure to the vend opening.

3. The apparatus recited in claim 2 wherein the chute has a low friction surface and a gradual curvature below the storage and dispensing means to the front of the enclosure.

4. The apparatus recited in claim 2 wherein a plurality of the storage and dispensing means are disposed in a unitary horizontal tray removably fitted within the enclosure, the tray having a back side adjacent to the feed chute.

5. The apparatus recited in claim 4 further comprising an individual sensor for each storage and dispensing means on the tray.

6. The apparatus recited in claim 5 wherein each sensor is positioned adjacent the back side of the tray and in line with a corresponding one of the storage and dispensing means.

7. The apparatus recited in claim 6 wherein the tray back side is bevelled downwardly and outwardly toward the chute, the sensor positioned along the bevelled surface.

8. The apparatus recited in claim 4 further comprising plural trays removable fitted in the enclosure, each tray having a back side adjacent to the feed chute.

9. The apparatus recited in claim 1 further comprising means for receiving and verifying credit or debit card information during the vending of an article responsive to the initiation by a customer of a vend selection sequence.

10. Apparatus for vending article comprising:

an enclosure having an opening through which selected articles are vended;

plural article selection means along a front panel of the enclosure for permitting a customer to select one of a plurality of articles through initiation of a vend selection sequence;

multiple independent article storing and dispensing means within the enclosure, each storage and dispensing means capable of storing a plurality of articles and then dispensing an individual article along a path within the enclosure toward the vend opening, the vend opening being positioned below all of the storage and dispensing means and the path being defined by a gravity feed chute through the enclosure to the vend opening, with a plurality of the storage and dispensing means disposed in a unitary horizontal tray within the enclosure, the tray having a back side adjacent to the feed chute and with the tray back side bevelled downwardly and outwardly toward the chute;

a sensor positioned along the bevelled backside at each storage and dispensing means and along the path for detecting when an individual article for the corresponding storage and dispensing means is moving along the path toward the vend opening, and providing a sensing output responsive thereto;

means for controlling the operation of the selected storage and dispensing means responsive to the sensor output to insure that a selected article is dispensed into the vend opening; and wherein the tray includes a front side opposite from the bevelled back side, each storage and dispensing means comprising a helical storage rack extending between the front side and the discharge end and plural independent drive motors along the front side, each motor coupled for rotating a corresponding helical storage rack.

11. Apparatus for vending articles, comprising:

an enclosure having an opening through which selected articles are vended; p1 plural article selection means along a front panel of the enclosure for permitting a customer to select one of a plurality of articles through initiation of a vend selection sequence;

multiple independent article storing and dispensing means within the enclosure, each storage and dispensing means capable of storing a plurality of articles and then dispensing an individual article along a path within the enclosure toward the vend opening, with a plurality of horizontal trays removably fitted in the enclosure, each tray including a plurality of the storage and dispensing means and having a back side forming the discharge end;

a sensor at each storage and dispensing means and along the path for detecting when an individual article for the corresponding storage and dispensing means is moving along the path toward the vend opening, and providing a sensing output responsive thereto;

means for controlling the operation of the selected storage and dispensing means responsive to the sensor output to insure that a selected article is dispensed into the vend opening;

plural storage position bar code reader stripes across a front side of each tray, each storage position bar code reader stripe fixed adjacent to and corresponding to one of the storage and dispensing means and having a unique storage position code;

plural article selection bar code reader stripes, each corresponding to one of the article selection means on the front of the enclosure; and a bar code reader within the enclosure for reading and providing control and inventory storage signals representative of the universal price code (UPC) stripe of articles to be inserted in each storage and dispensing means, the storage position bar code reader stripe for each storage and dispensing means where each article is to be placed, and the article selection bar code reader stripe for each article.

12. The apparatus recited in claim 11 further comprising means for providing plural quantity bar code stripes, each quantity stripe representative of a quantity of articles loaded into a corresponding storage and dispensing means.

13. The apparatus recited in claim 12 further comprising means for receiving, storing and transmitting inventory information relative to the identity and quantity of articles stored in each storage and dispensing means.

14. A method for reliably vending articles, comprising the steps of:

providing an enclosure having plural article selection means along a front panel thereof, for permitting a customer to select one of a plurality of articles through initiation of a vend selection sequence;

removably installing within the enclosure plural independent article storing and dispensing means, each capable of storing a plurality of articles and then dispensing an individual article along a path within the enclosure toward a vend opening;

sensing when an individual article for each storage and dispensing means is moving along the path toward the vend opening, and providing a first sensing output responsive thereto;

sensing when an individual article is discharged from a corresponding article storing and dispensing means, and providing a second sensing output responsive thereto; and controlling the operation of the selected storage and dispensing means responsive to both the first and second sensor outputs to insure that a selected article is dispensed into the vend opening.

* * * * *